US005947738A

United States Patent [19]

Muehle et al.

[11] Patent Number: 5,947,738

[45] Date of Patent: Sep. 7, 1999

[54] SIMULATED WEAPON WITH GAS CARTRIDGE

[75] Inventors: Eric G. Muehle; Erwin C. Treat, Jr., both of Maple Valley, Wash.

[73] Assignee: Advanced Interactive Systems, Inc., Tukwilla, Wash.

[21] Appl. No.: 08/697,537

[22] Filed: Aug. 26, 1996

[51] Int. Cl.[6] ..... G09B 19/00

[52] U.S. Cl. ..... 434/16; 434/11; 434/18; 124/57

[58] Field of Search ..... 434/16, 11, 17–24; 124/55–77

[56] References Cited

U.S. PATENT DOCUMENTS

| | | | |
|---|---|---|---|
| 3,590,225 | 6/1971 | Murphy . | |
| 3,996,674 | 12/1976 | Pardes et al. . | |
| 4,290,757 | 9/1981 | Marshall et al. . | |
| 4,657,511 | 4/1987 | Allard et al. . | |
| 4,678,437 | 7/1987 | Scott et al. | 434/21 |
| 4,680,012 | 7/1987 | Morley et al. . | |
| 4,695,256 | 9/1987 | Eichweber . | |
| 4,788,441 | 11/1988 | Laskowski . | |
| 4,804,325 | 2/1989 | Willits et al. . | |
| 4,948,371 | 8/1990 | Hall . | |
| 4,982,123 | 1/1991 | Scott et al. | 434/21 |
| 4,988,111 | 1/1991 | Gerlizt et al. . | |
| 5,194,006 | 3/1993 | Zaenglein, Jr. . | |

FOREIGN PATENT DOCUMENTS

| | | |
|---|---|---|
| 1 527 883 | 10/1978 | United Kingdom . |

*Primary Examiner*—Glenn E. Richman
*Attorney, Agent, or Firm*—Seed and Berry LLP

[57] ABSTRACT

A simulated weapon includes a pressure switch within the simulated weapon's barrel. The pressure switch responds to pressure changes within the weapon barrel to activate a light emitter. In response, the light emitter emits a beam of light that simulates weapon fire by indicating the aim of the simulated weapon. Pressure changes within the barrel are induced by a conventional air cartridge that emits a blast of air when struck by the firing pin of the simulated weapon. The user can thus produce the simulated fire by activating the simulated weapon's trigger to trip the hammer and drive the firing pin into the air cartridge. In another embodiment, the simulated weapon activates a nonlethal pyrotechnic round. Simulated fire is produced in response to detection of the recoil, force, or pressure change produced by the pyrotechnic round. The simulated weapon may be a pistol, rifle or any other conventional hand held weapon.

23 Claims, 6 Drawing Sheets

SIMULATED WEAPON WITH GAS CARTRIDGE

TECHNICAL FIELD

The present invention relates to simulated weapons and weapons training.

BACKGROUND OF THE INVENTION

Weapons ranges provide environments in which users can be trained in the use of weapons or can refine weapons use skills. At such weapons ranges, users typically train with conventional firearms, such as pistols and rifles, fired from a participation zone in which the participant is positioned. For example, a participant may fire a pistol from a shooting location toward a bull's-eye paper target. A bullet travels from the pistol toward the paper target and, if properly aimed, penetrates the paper target at or near the bull's eye. As the bullet penetrates the paper target, the bullet leaves a hole. The location of the hole indicates the accuracy of the aim.

To improve the realism of the weapons familiarization process and to provide a more "lifelike" experience, a variety of approaches have been suggested to make the weapons range more realistic. For example, some weapons ranges provide paper targets with threatening images, rather than bull's-eye targets.

In attempts to present a more realistic scenario to the participant and to provide an interactive and immersive experience, some weapons ranges have replaced such fixed targets with moving or "pop-up" targets such as spring-loaded mechanical images or animated video images projected onto a display screen. The pop-up or animated images present moving targets and/or simulated return threats toward which the participant fires. One problem with such an approach is that the bullets damage or destroy the target. For example, the bullets can punch holes through display screens, eventually rendering the screens inoperative. Further, use of live ammunition can be very dangerous, especially in unfamiliar training exercises where the participant's performance limits are tested.

To address such problems, some training ranges use nonlethal ammunition, such as projectiles propelled by air cartridges in place of conventional bullets. One type of nonlethal ammunition is a Crown Type E air cartridge. In conventional uses of such cartridges, a releasable cap attaches to the cartridge and covers an outlet port. Then, when the outlet port is opened, a highly pressurized gas is released from the cartridge and propels the releasable cap away from the cartridge at a high velocity. The cap travels through a gun barrel and is emitted from the gun as a nonlethal projectile. To detect the impact locations of the nonlethal projectile, some such ranges use some type of projectile tracking device, such as high-speed imaging equipment. Such ranges can be very expensive due to their complexity and use of specialized equipment.

Other ranges allow the nonlethal ammunition to penetrate or otherwise mark a target object to indicate impact location. Such ranges have the drawback that the nonlethal ammunition is destructive. Additionally, the impact locations are difficult to track on a "real-time" basis, which makes interactive ranges difficult. Also, while such approaches may improve visual approximations of actual situations as compared to paper targets, such approaches lack a visual or other virtually instantaneous feedback indicating the effectiveness of the participant's fire.

Another alternative type of weapons range employs a light beam in place of a projectile. In such ranges, the participant holds a simulated weapon shaped like a conventional weapon that is activated by a switch coupled to a conventionally shaped and positioned trigger. When the participant pulls the trigger, the simulated weapon emits a light beam that strikes the target, causing an illuminated spot. An optical detector detects the spot and indicates the impact location.

Such simulated weapons lack a realistic feel because they do not recoil in response to the simulated fire. Moreover, the simulated weapons do not emit shells that can distract the participant and can affect the participant's footing.

To try to simulate an actual weapon's recoil, a compressed air line can be coupled to the simulated weapon. Then, when the trigger is pulled, an air driven mechanism applies a pulse of force to the simulated weapon to produce a simulated recoil. Such a system has the drawback that the air line acts as a tether, limiting the participant's mobility and affecting aim. The system also lacks the ejected shells of actual or nonlethal ammunition.

SUMMARY OF THE INVENTION

A simulated weapon according to one aspect of the invention includes a pressure sensor carried by a frame and coupled to a light emitter that emits a light beam in response to detected pressure changes. The simulated weapon may include a frame shaped according to a conventional firearm, such as a pistol or a rifle. The pressure sensor is mounted within the barrel of the simulated weapon and includes a spring-driven plunger mechanism. A gas cartridge shaped according to conventional ammunition is placed within the gun barrel and activated by a firing pin controlled by the simulated weapon's trigger.

When the gas cartridge is activated, the cartridge releases gas to pressurize the barrel and activate the pressure sensor. In response to activation of the pressure sensor, the optical emitter emits a beam of light outwardly from the simulated weapon.

Like a conventional weapon, the simulated weapon preferably emits a loud "report" as the gas is expelled from the gas cartridge. Additionally, the expulsion of gas from the gas cartridge preferably causes a recoil of the simulated weapon, further simulating actual weapon fire. Also, the gas cartridges may be sized and shaped like conventional ammunition and are ejected from the simulated weapon with a conventional ejector mechanism producing debris similar to that of conventional weapons. Thus, the simulated weapon can produce sound, recoil, and debris in a conventionally sized, untethered weapon, without the danger, complexity and cost of emitting and tracking lethal or nonlethal projectiles.

In a weapons training environment according to the invention, a participant aims the simulated weapon at a projected image and activates the simulated weapon, causing the simulated weapon to emit a beam of light. Optical detectors detect light spots produced by the light beams. A microprocessor-based central controller then determines the accuracy and timeliness of the participant's fire by comparing the location of the light spot to a desired impact location.

DETAILED DESCRIPTION OF THE INVENTION

Figure 1:
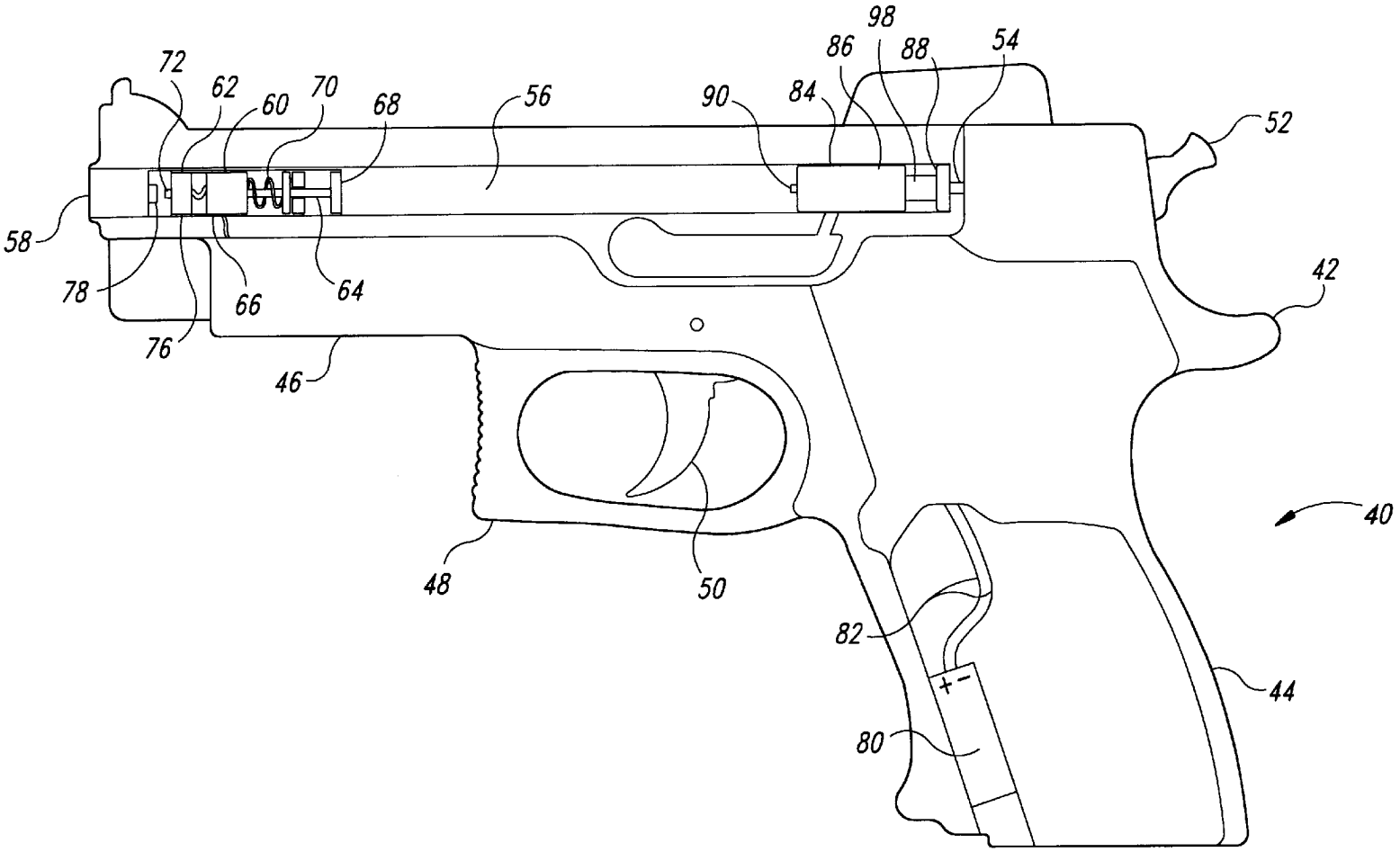
FIG. 1 is a side elevational view of a simulated weapon according to the invention with selected portions cut away to reveal the barrel and power source.

FIG. 1 shows a simulated weapon 40 shaped and sized according to a typical commercially available handgun. While the simulated weapon 40 simulates a typical pistol, the simulated weapon 40 may be shaped and sized to simulate any other conventional firearm, such as a rifle.

As is conventional for actual weapons, the simulated weapon 40 includes a frame 42 that has a handle portion 44 shaped for grasping by a hand and a main section 46 having a barrel 56. The frame 42 also includes a trigger guard 48 that adjoins a lower edge of the main section 46 and a front edge of the handle portion 44. The frame 42 is formed according to conventional handgun fabrication techniques from metal, plastic, and/or organic composites.

The trigger guard 48 encircles a trigger 50 that is used to activate the simulated weapon 40. The trigger 50 is linked to a hammer 52 that is pivotably mounted at a rear edge of the main section 46. In response to the trigger 50 being pulled, the hammer 52 pivots according to a typical spring release mechanism and strikes a firing pin 54. When the hammer 52 strikes the firing pin 54, the hammer 52 drives the firing pin 54 axially along the barrel 56 to produce simulated fire, as will be described below.

As is conventional for actual weapons, the barrel 56 is a cylindrical passageway in the main section 46 that extends from the firing pin 54 to an exit 58. Unlike a conventional weapon, however, the simulated weapon 40 includes a pressure switch 60 and light emitter 62 positioned within the barrel 56 near the exit 58. The pressure switch 60 includes a spring-loaded shaft 64 that extends axially along the barrel 56 from a switch body 66 toward the firing pin 54. A pressure plate 68 is mounted to the distal end of the shaft 64. The pressure plate 68 is a circular disk that conforms to the circular cross section of the barrel 56. A spring 70 biases the shaft 64 and pressure plate 68 rearwardly toward the firing pin 54.

The light emitter 62 is electrically coupled for activation by the pressure switch 60. The light emitter 62 is formed from a laser diode 72 mounted to a baseplate 76 and an optical assembly 78 mounted between the laser diode 72 and the exit 58. The laser diode 72 is a commercially available device that emits light in response to an electrical current. The optical assembly 78 contains appropriate lenses and filters to collimate and filter the light emitted by the laser diode 72.

In another departure from a conventional weapon, the simulated weapon 40 includes a battery 80 preferably concealed within the handle portion 44. The battery 80 is coupled to the pressure switch 60 through a wire pair 82 to provide power to the laser diode 72.

In operation, a nonlethal round 84 is placed within the barrel 56. The nonlethal round 84 can be a commercially available product, such as a Crown Type "E" air cartridge that is sized and shaped to simulate conventional ammunition. Alternatively, the nonlethal round 84 can be a nonlethal pyrotechnic round such as a 9 mm FX round available from Simunitions. In the preferred embodiment of a gas cartridge, the nonlethal round 84 includes a main chamber 86 having a striking plate 88 at an end facing the firing pin 54 and an outlet port 90 at the opposite end. The main chamber 86 is a rechargeable high pressure chamber that contains a pressurized gas, such as air, at about 3500 psi.

Figure 2:
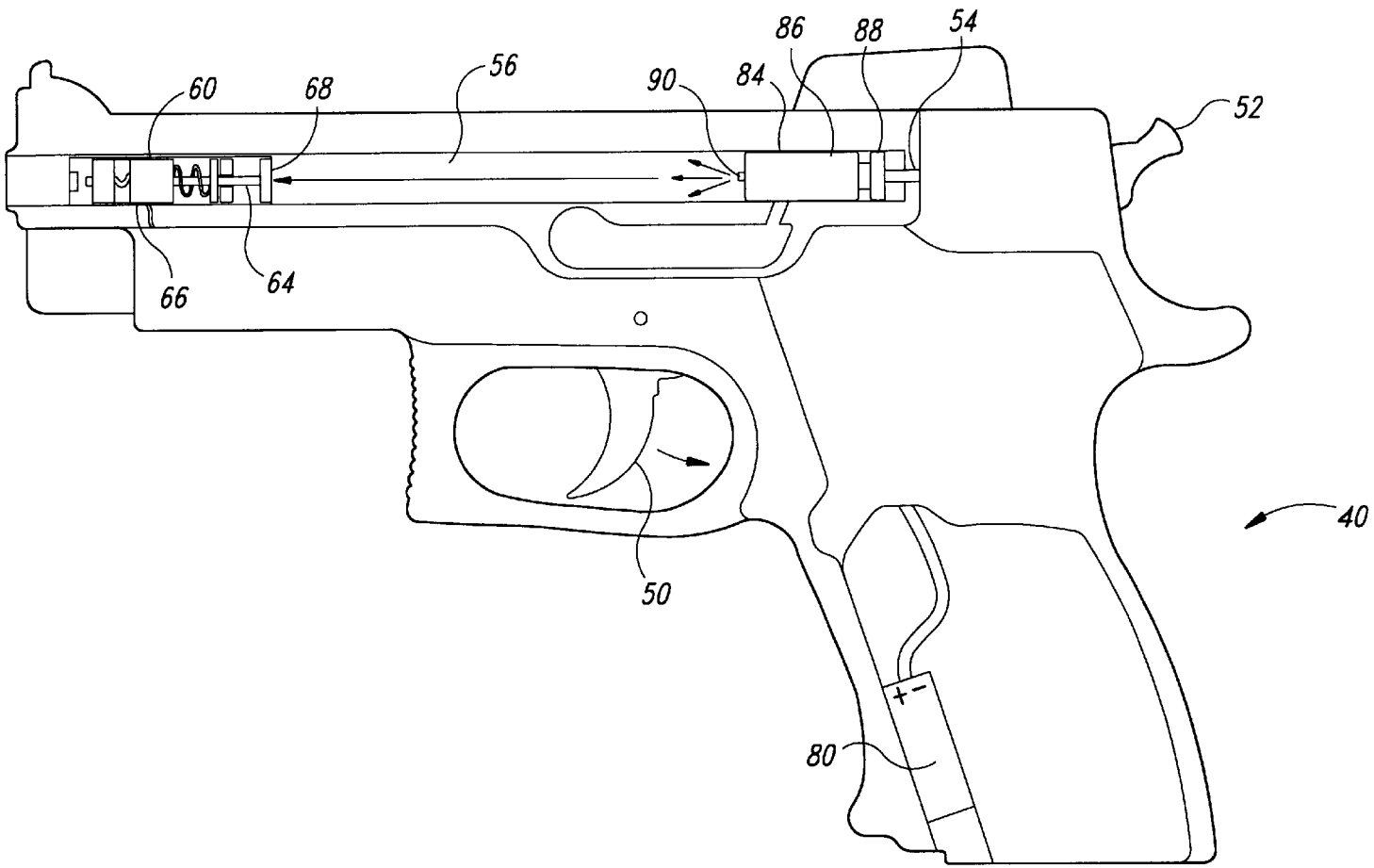
FIG. 2 is a side elevational view of the simulated weapon of FIG. 1 with selected portions cut away and showing the firing pin activating the gas cartridge.

When a user activates the simulated weapon 40 by pulling the trigger 50, the hammer 52 falls and drives the firing pin 54 into the striking plate 88. In response, the striking plate 88 depresses a plunger 98 to open the outlet port 90 and allow the high pressure gas within the chamber 86 to escape, as shown in FIG. 2. Because no cap is attached to the nonlethal round 84, no projectile is released. Instead, the escaping gas quickly pressurizes the barrel 56, exerting a force on the pressure plate 66, thereby forcing the shaft 64 toward the switch body 66. The weapon 40 can operate similarly when the nonlethal round 84 is a pyrotechnic round rather than a gas cartridge. In this embodiment, the hammer 52 drives the firing pin 54 into the pyrotechnic round. In response, powder within the pyrotechnic round explodes. The explosion quickly pressurizes the chamber 86 to force the shaft 64 toward the switch body 66.

Figure 3:
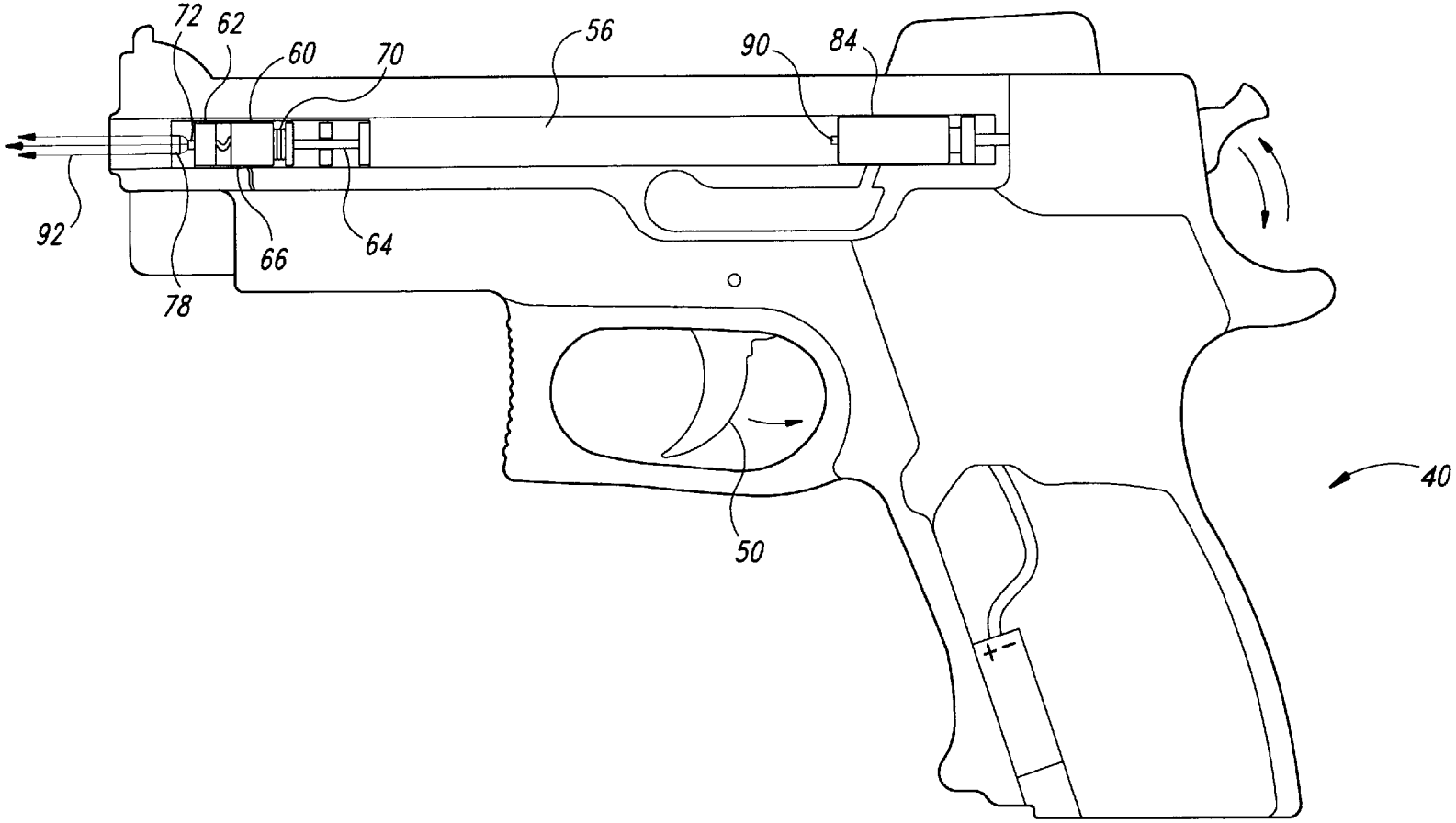
FIG. 3 is a side elevational view of the simulated weapon of FIG. 2 during activation with selected portions cut away and showing the plunger depressed to activate the light emitter.

Regardless of the type of nonlethal round 84, the shaft 64 responds to the force by sliding into the switch body 66, thereby activating the switch 60 and compressing the spring 70, as shown in FIG. 3. The activated switch 60 couples power from the battery 80 into the light emitter 62 causing the laser diode 72 to emit light. The optical assembly 78 collimates and filters the emitted light, producing a collimated light beam 92.

Figure 4:
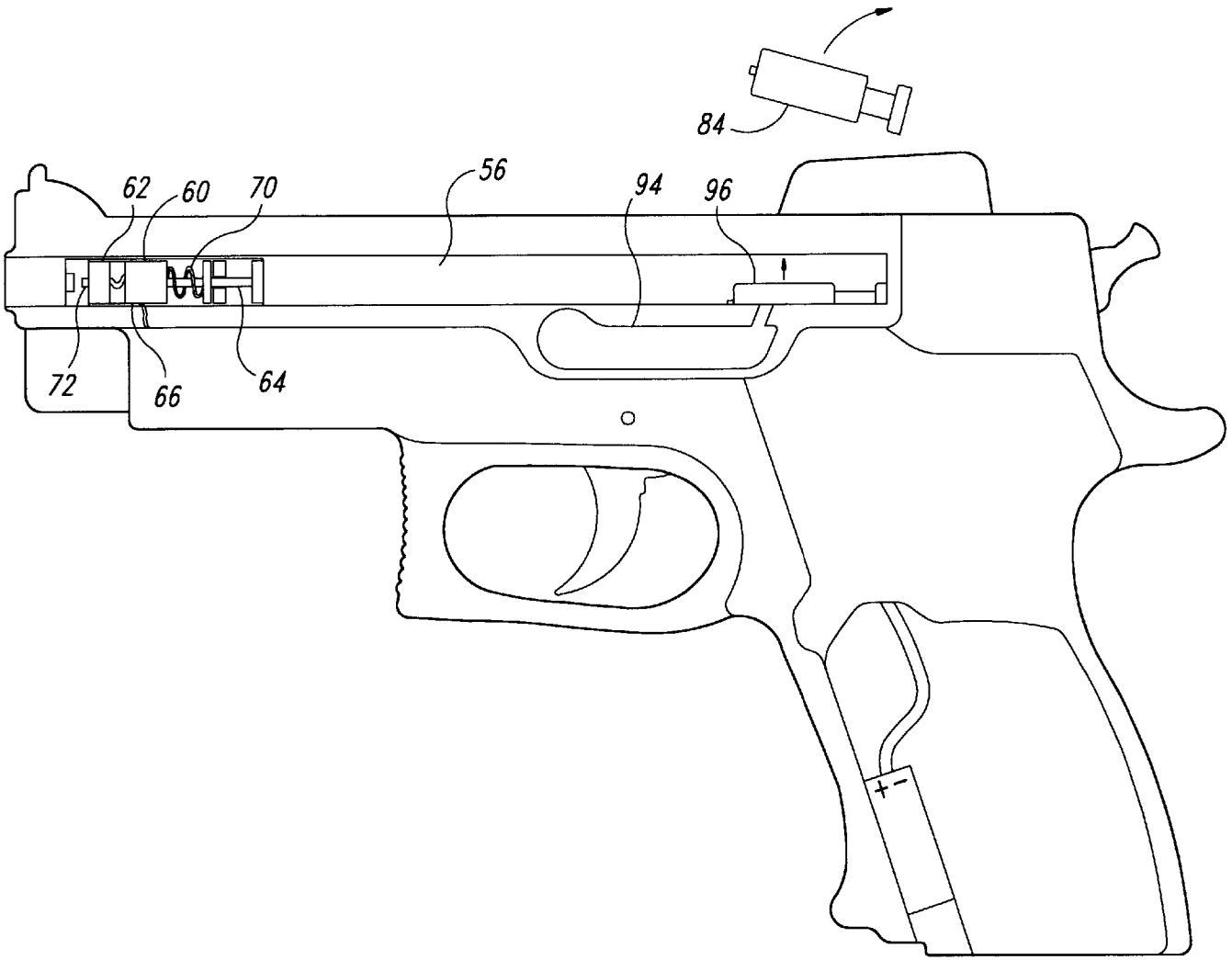
FIG. 4 is a side elevational view of the simulated weapon of FIG. 2 after activation with selected portions cut away and showing the plunger returned to its resting position with the original gas cartridge being ejected.

The pressure within the barrel 56 quickly equalizes and, as shown in FIG. 4, the spring 70 forces the shaft 64 to slide rearwardly from the switch body 66 to its resting position, thereby opening the switch 60 and deactivating the light emitter 62. At approximately the same time, a casing ejector 94 ejects the nonlethal round 84 and a new cartridge 96 slides into place. The simulated weapon 40 then returns to the original configuration of FIG. 1, except for the loss of the original nonlethal round 84, and is ready to be fired once again.

When the simulated weapon 40 is activated and the nonlethal round 84 expels the stored gas through the outlet port 90 (or fires in the case of the pyrotechnic round), the nonlethal round 84 is quickly forced against the frame 42 and thus exerts an abrupt force on the frame 42. The frame 42 is thereby forced back toward the user's hand providing a recoil similar to that of a conventional weapon firing conventional ammunition.

Figure 5:
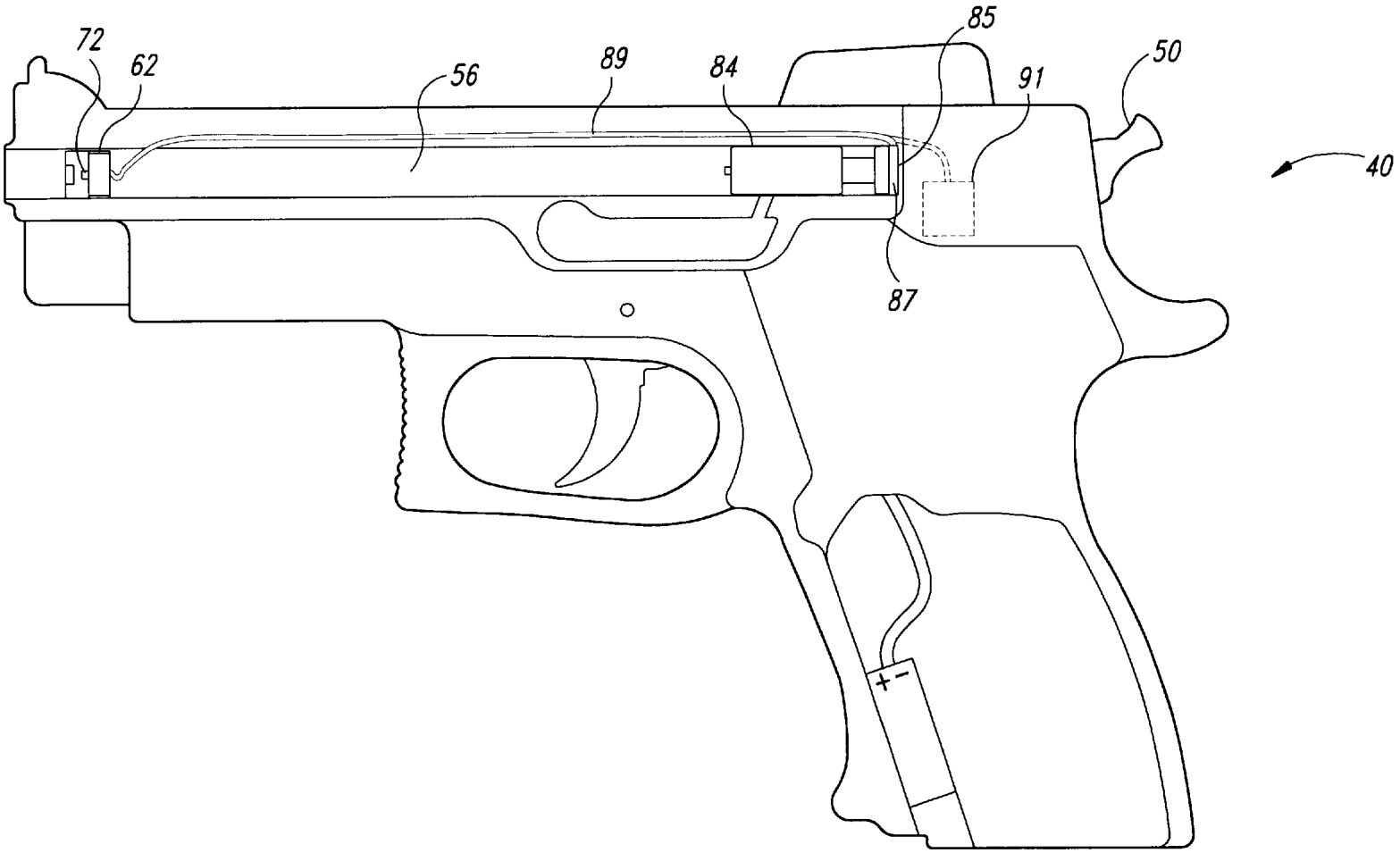
FIG. 5 is a side elevational view of an alternative embodiment of the simulated weapon with selected portions cut away and showing a pressure sensor mounted at the rear of the weapon chamber.

As shown in FIG. 5, in an alternative embodiment of the invention, particularly appropriate for pyrotechnic rounds, the pressure plate 66, switch 60, spring 70 and shaft 64 are removed. Instead, the light emitter 62 is activated by a recoil sensor 85 formed from a piezoelectric transducer 87 mounted at the rear of the chamber 56. When the nonlethal round 84 is activated by the trigger 50 and the nonlethal round 84 is forced rearwardly in the chamber 56, the nonlethal round 84 applies an abrupt force against the pressure sensor 85. In response, the piezoelectric transducer 87 generates a voltage that is carried by a pair of wires 89 to the light emitter 62. The voltage from the wires 89 activates the light emitter 62 and the light emitter 62 emits a beam of light as described above with respect to FIG. 3.

As a further alternative, to the embodiment of FIG. 5, the pressure sensor 85 can be replaced by a jiggle switch 91 (shown in broken lines in FIG. 5). Jiggle switches are known switches that are activated by vibration or impact. A variety of available jiggle switches can be adapted for application to the simulated weapon 40. In this embodiment, the jiggle switch 91 is located to the rear of and slightly below the chamber 56. When the nonlethal round 84 produces a recoil, as described above, the recoil activates the jiggle switch 91. The jiggle switch 91 then activates the light emitter 62 to produce the beam of light 92, as described above.

Figure 6:
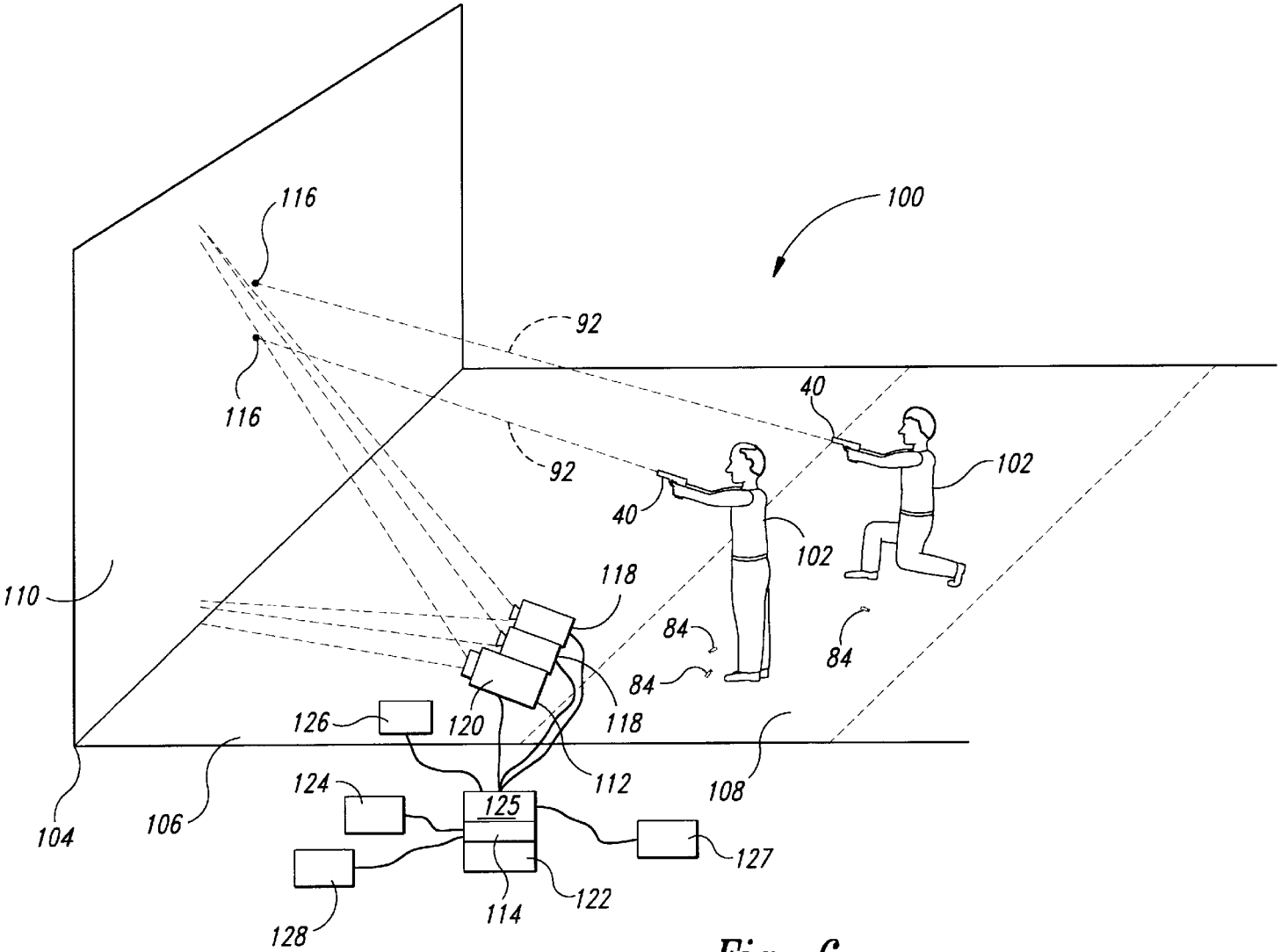
FIG. 6 is a side isometric view of a weapons range environment including two participants operating simulated weapons according to the invention.

FIG. 6 shows a weapon range 100 in which two participants 102 fire respective simulated weapons 40 according to the invention. The weapons range 100 is formed from a target zone 104, an intermediate zone 106 and a participation zone 108. The target zone 104 and participation zone 108 are at opposite ends of the weapons range 100 and are separated by the intermediate zone 106.

The target zone 104 includes a display panel 110 formed from a white denier cloth. An image projector 112 driven by an electronic central controller 114 projects images onto the display panel 110 using conventional display technology, such as a projection television 120 and a computer controlled laser disk player 122. The central controller 114 is a computer-controlled set of electronic devices that includes a microprocessor 125, a memory device 127, the laser disk player 122, a monitor 124, an audio detector 126, an input panel 128, such as a keyboard, touch screen, or voice recognition device, and any other devices applicable to the particular environment, such as position sensors, discriminators, or sound production equipment.

The projected images are produced by the image projector 112 in response to a multibranch program from the laser disk player 122, where the selection of branches is controlled by the microprocessor 125 in response to a software program stored in the memory device 127. The projected images typically include combat or police action scenarios, including selected threatening subscenarios. For example, a scenario may be a combat situation and a corresponding threatening subscenario may be an armed enemy pointing a weapon toward the participation zone 108.

In response to the threat, the participants 102 activate the weapons 40 to direct simulated fire, i.e., the light beams 92, toward the display panel 110. As the light beams 92 strike the display panel 110, they produce respective light spots 116.

A pair of optical detectors 118 positioned in the intermediate zone 106 detect the light spots 116 and indicate to the central controller 114 the impact locations of the light beams 92. The optical detectors 118 are preferably video cameras including two dimensional detector arrays, although one skilled in the art will recognize various other structures that can be adapted for use as the optical detectors 118.

The central controller 114 can discriminate between light spots 116 from the different simulated weapons 40 in a variety of fashions. For example, in one embodiment, the simulated weapons 40 emit light at different wavelengths. The laser diodes 62 can be selected to emit light at the different wavelengths, or the laser diodes 62 can be replaced with conventional light emitting diodes that are wavelength filtered by their respective optical assemblies 78. The optical detectors 118 each include respective optical filters corresponding to the wavelength of the respective simulated weapons 40.

Alternatively, the simulated weapons 40 can each have a respective "signature" recognizable by the respective optical detectors 118. For example, the laser diodes 62 can be pulsed, frequency modulated, or otherwise modulated, according to respective patterns. Filters, demodulators or other discriminators are then coupled to the optical detectors 118 to decode pulse patterns or detect specific modulation patterns or frequencies of the respective laser diodes 62 and thereby discriminate between the light spots 116.

Once the central controller 114 identifies the impact locations of the respective light beams 92, the central controller 114 then compares the respective impact locations to desired impact locations corresponding to the specific threatening subscenarios to determine the timeliness and accuracy of the participants' responses. At the end of the scenario, the central controller 114 presents a summary and evaluation on the monitor 124 in a conventional manner.

Like conventional weapons, the simulated weapons 40 produce a loud report, i.e., emit loud sound, when the nonlethal round 84 abruptly expels gas into the barrel 56. The report further simulates actual weapon fire to provide a more immersive experience to the participants 102.

The loud report also allows the audio detector 126 to detect the sounds of the fired simulated weapons 40 to provide an auxiliary indication to the central controller 114 that shots are fired. If the audio detector 126 detects shots being fired, but the optical detectors 118 do not detect an impact location on the display panel 110, the central controller 114 can thereby determine that a missed shot has been fired.

As can be seen in FIG. 6, as the participants 102 fire, the weapons 40 eject the spent nonlethal rounds 84 into the participation zone 108. The ejected nonlethal rounds 84 more accurately simulate real life combat situations by forcing the participants 102 to be aware of the danger of slipping on the nonlethal rounds 84. Consequently, the simulated weapons 40 produce sound, recoil, and debris proportional to the firing activity, all without employing a tether.

From the foregoing, it will be appreciated that, although an exemplary embodiment of the invention has been described herein for purposes of illustration, various modifications may be made without deviating from the spirit and scope of the invention. For example, a single participant, or more than two participants 102 can have simulated weapons 40 in the participation zone 108. Additionally, the simulated weapons 40 can be adapted for use in competitive environments, such as "laser tag" or similar games or exercises. Similarly, the pressure plate 66, shaft 64, and switch 60 of the embodiment of FIG. 1 can be replaced by a variety of appropriate pressure detectors at any location in the chamber 56. For example, piezoelectric transducers with accompanying electronic circuitry can detect pressure changes and activate the light emitter 62. Accordingly, the invention is not limited, except as by the appended claims.

We claim:

1. A simulated weapon, comprising;

a frame;

a nonlethal round;

a trigger carried by the frame and configured to activate the nonlethal round;

a switch carried by the frame and configured to detect a recoil of the weapon in response to the activation of the nonlethal round; and a light emitter mounted to the frame and electrically coupled to the switch, the light emitter being operative to emit light in response to activation of the switch.

2. The simulated weapon of claim 1 wherein the switch includes a force sensor positioned to detect a recoil force exerted by the nonlethal round when the nonlethal round is activated.

3. The simulated weapon of claim 2 wherein the force sensor includes a piezo-electric switch engaging a surface of the nonlethal round.

4. The simulated weapon of claim 1 wherein the nonlethal round includes a gas cartridge and the switch includes a piezo-electric sensor.

5. The simulated weapon of claim 1 wherein the nonlethal round is a pyrotechnic round.

6. An untethered simulated weapon, comprising:

a frame having a barrel including a chamber adapted for pressurization;

a pressure sensor carried by the frame and positioned to detect a pressure change within the chamber, the pressure sensor producing a pressure signal in response to the detected pressure change within the chamber; and a light emitter coupled to the pressure sensor and operative to emit simulated fire along a selected optical path relative to the frame in response to the pressure signal.

7. The simulated weapon of claim 1 wherein the light emitter includes a laser diode.

8. The simulated weapon of claim 6 wherein the pressure sensor includes:

a switch; and a pressure pad positioned within the barrel and coupled to the switch.

9. The simulated weapon of claim 8 wherein the pressure sensor includes a plunger coupled between the pressure pad and the switch.

10. The simulated weapon of claim 6, further including a gas cartridge sized and shaped for positioning within the barrel, the gas cartridge containing the selectively releasable gas.

11. The simulated weapon of claim 10, further including a casing ejector positioned to eject the gas cartridge from the barrel.

12. A weapons training environment, comprising:

a target region;

a simulated first weapon, including a recoil sensor positioned to detect a recoil of a first nonlethal round within the first weapon, and a first light emitter responsive to emit a first optical beam along a selected first optical path relative to the first weapon in response to the detected recoil, the first optical path being selected such that the first optical path intersects a portion of the target region when the first weapon is in a desired alignment relative to the target region; and an optical detector aligned to the target region, the optical detector being responsive to detect the first optical beam intersecting the target region.

13. The weapons range environment of claim 12, wherein the first nonlethal round comprises a gas cartridge sized and shaped for insertion in the first weapon, the gas cartridge being operative to produce a pressure change within the first weapon in response to activation of the weapon.

14. The weapons range environment of claim 12, further including a shot detector separate from the first weapon.

15. The weapons range environment of claim 1, further including an electronic comparator coupled to the shot detector and the optical detector.

16. The weapons range environment of claim 12, further including a discriminator coupled to the optical detector.

17. The weapons range environment of claim 12, further including a second simulated weapon, including a second recoil sensor positioned to detect a recoil of a second nonlethal round within the second weapon, and a second light emitter responsive to emit a second optical beam along a selected second optical path relative to the second weapon in response to the detected recoil within the second weapon, the second optical path being selected such that the second optical path intersects a respective portion of the target region when the second weapon is in a desired alignment relative to the target region.

18. The weapons range environment of claim 17 wherein the first and second optical beams are substantially at first and second wavelengths and the optical detector is responsive to differentiate between light of the first and second wavelengths.

19. The weapons range environment of claim 17 wherein the first and second optical beams are modulated according to first and second modulation patterns and the optical detector is responsive to differentiate between the first and second patterns.

20. A simulated weapon for firing a nonlethal round, comprising:

a frame having a chamber for selectively receiving the nonlethal round;

a trigger carried by the frame and configured to activate the nonlethal round;

a piezoelectric sensor positioned in the chamber to detect a recoil of the nonlethal round; and a light emitter mounted to the frame and electrically coupled to the sensor, the light emitter being operative to emit light in response to activation of the piezoelectric sensor.

21. The simulated weapon of claim 20, further including a gas cartridge sized and shaped for positioning within the barrel, the gas cartridge containing the selectively releasable gas.

22. The simulated weapon of claim 21, further including a casing ejector positioned to eject the gas cartridge from the barrel.

23. The simulated weapon of claim 20, further including an electrical power source carried by the frame and coupled to the optical emitter.

* * * * *